US005154025A

United States Patent [19]

Brown

[11] Patent Number: 5,154,025

[45] Date of Patent: Oct. 13, 1992

[54] COILABLE ROOF DRIP EDGE

[75] Inventor: Randall J. Brown, Granger, Ind.

[73] Assignee: Aeroquip Corporation, Elkhart, Ind.

[21] Appl. No.: 487,104

[22] Filed: Mar. 2, 1990

[51] Int. Cl.[5] ..... E04D 1/36

[52] U.S. Cl. ..... 52/58; 52/12

[58] Field of Search ..... 52/11, 12, 58, 62, 94, 52/96, 97, DIG. 3

[56] References Cited

U.S. PATENT DOCUMENTS

| | | | |
|---|---|---|---|
| 1,178,673 | 4/1916 | Plank | 52/630 X |
| 3,172,236 | 3/1965 | Weckerly et al. | 52/58 |
| 3,295,264 | 1/1967 | Olson | 52/12 |
| 3,300,913 | 1/1967 | Patry et al. | 52/58 |
| 3,367,070 | 2/1968 | Mitchell | 52/12 |
| 3,643,388 | 2/1972 | Parr et al. | 52/58 |
| 4,018,017 | 4/1977 | Schoop | 52/58 X |
| 4,666,785 | 5/1987 | Crepeau | 52/58 X |
| 4,741,132 | 5/1988 | Emblin | 52/58 |
| 4,750,301 | 6/1988 | Croxford | 52/58 |
| 4,890,426 | 1/1990 | Hickman et al. | 52/58 |

FOREIGN PATENT DOCUMENTS

| | | | |
|---|---|---|---|
| 1392180 | 4/1975 | United Kingdom | 52/58 |

*Primary Examiner*—Renee S. Luebke
*Assistant Examiner*—Suzanne L. Dino
*Attorney, Agent, or Firm*—Emch, Schaffer, Schaub & Porcello

[57] ABSTRACT

A roof drip edge for application between the outer roofing material and roof board along the roof edge fascia board having a depending web which is connected by a flexible joint to the cover flange of the drip edge which fits between the roofing material and roof board. In this manner the web may be folded against the cover flange with the cover flange and web being formed of a material sufficiently flexible to allow the flange to be coiled upon itself with the web folded against the flange.

3 Claims, 2 Drawing Sheets

COILABLE ROOF DRIP EDGE

SUMMARY OF THE INVENTION

This invention relates to a roof drip edge which is installed along the fascia edge of a roof for the purpose of providing a clean drip surface for roof runoff and to prevent water and ice from working back up under the shingles of the roof.

Heretofore, roof drip edges have been formed of aluminum or galvanized steel, and generally come in ten foot lengths. Due to their length and material composition, such edges are difficult to handle and to install and are also easily dented or bent. Such dented or bent edges when installed can be unattractive and can form undesirable gaps, which allows water to work its way back up under the roofing shingles. Roof drip edges of rigid plastic material have also been recently used in order to eliminate the denting and bending which occurs in metal edges. Such plastics edges which are cut into specific lengths, normally ten feet, are still difficult to handle and to install and have a tendency to break or crack in cold weather.

The roof drip edge of the following described invention is formed of a material having sufficient flexibility to allow it to be coiled upon itself and has its component parts connected by flexible joints which allow the edge to be flattened after manufacture and coiled for ease of shipping and storage as well as application to the roof. Such coiled drip edge may be any convenient length for the desired application, such as 160 or more feet (the average amount required for a house), which will enable the drip edge to be carried in its coiled form to the roof and uncoiled along the roof edge and thereafter cut to a proper length. The component parts of the cut to length drip edge can then be unfolded and the drip edge properly applied along the edge of the roof in a simple and rapid manner. In the manufactured housing industry, the coiled drip edge may be applied to the housing from reels.

Accordingly, it is a purpose of this invention to provide a roof drip edge which can be applied along the edge of the roof in coiled form.

Another object of this invention is to provide for a roof drip edge which is of economical construction and of simple application.

Another object of this invention is to provide for a roof drip edge which may be stored for inventory in a compact, easily managed manner.

Still another object of this invention is to provide a seamless roof drip edge.

Other objects of this invention will become apparent upon a reading of the following description.

BRIEF DESCRIPTION OF THE DRAWINGS

A preferred embodiment has been chosen for illustration and description wherein.

DESCRIPTION OF THE PREFERRED EMBODIMENT

The following description is not intended to be exhaustive or to limit the invention to the precise form disclosed. Rather, it is chosen and described in order to best explain the principles of the invention and to enable others skilled in the art to utilize the invention.

Figure 1:
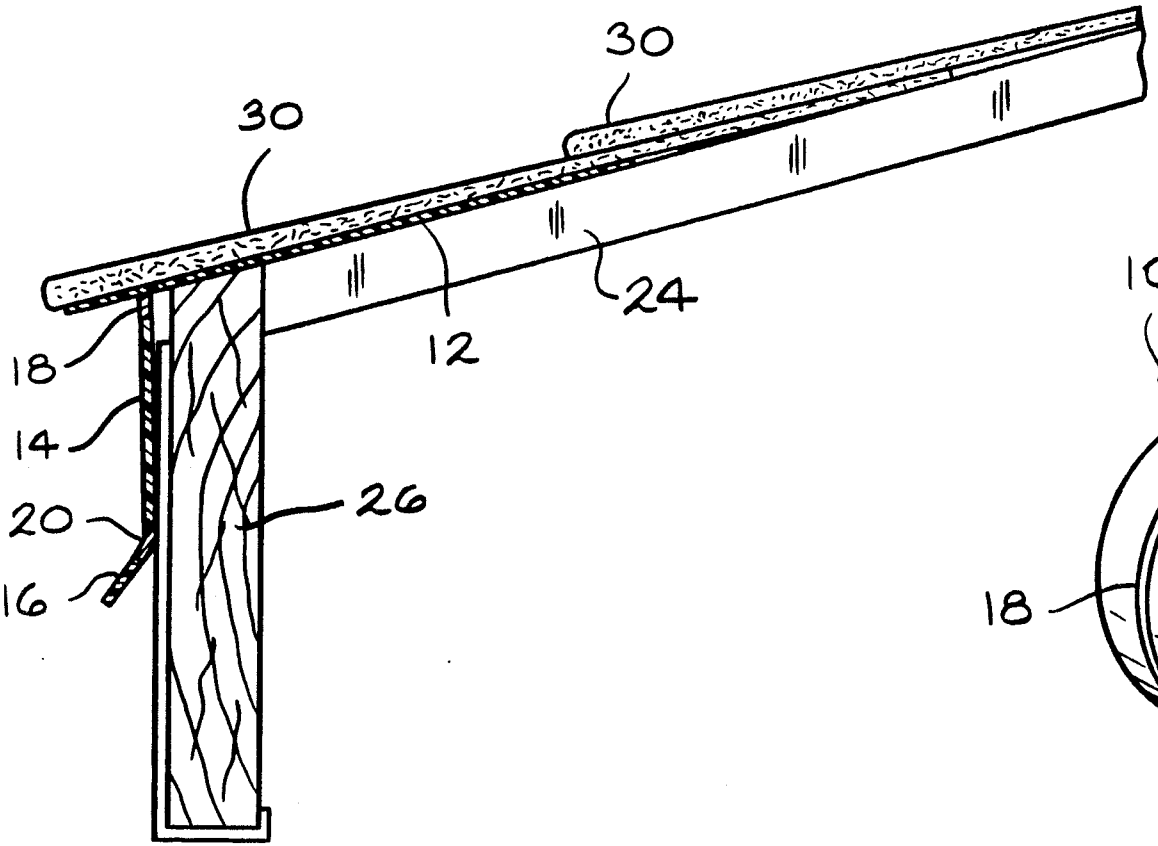
FIG. 1 is a fragmentary cross sectional view of a roof showing the drip edge of this invention applied.

Drip edge 10 as illustrated in the drawings is of elongated form having a uniform cross sectional profile. This profile in its installed form is best illustrated in FIG. 1 and includes a cover flange 12, a web 14 and a lip 16. Web 14 is connected at one end to cover flange 12 by a flexible joint 18, and lip 16 is connected to the opposite end of web 14 by a flexible joint 20.

Drip edge 10 may be formed from a variety of materials, each of which must have a sufficient flexibility to allow coiling of the drip edge upon itself. Such examples would be a flexible PVC, a combination of a more rigid PVC and a more flexible PVC which would be co-extruded with the more flexible PVC forming joints 18 and 20 interconnecting cover flange 12, web 14, and lip 16. Also, the cover flange, web and lip may be formed of a thin metal such as copper or aluminum with flexible PVC being applied to form the joints between the cover flange, web and lip.

Figure 2:
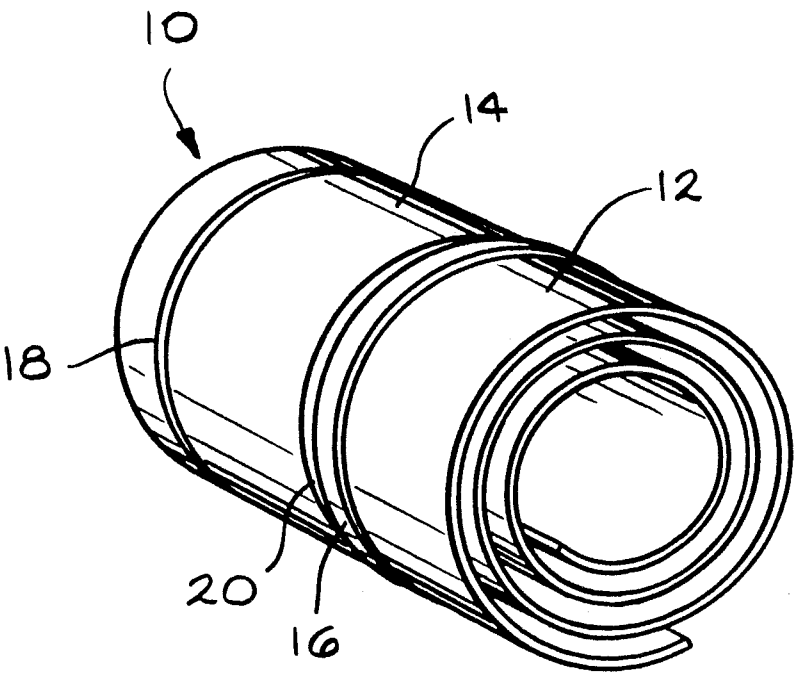
FIG. 2 is a perspective view of the drip edge shown in its coiled form prior to application.
Figure 4:
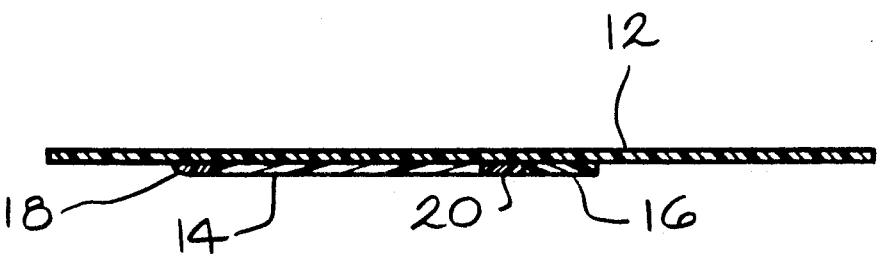
FIG. 4 is a cross sectional view taken along line 4—4 of FIG. 3 of the drip edge and showing the drip edge in its flattened form.
Figure 3:
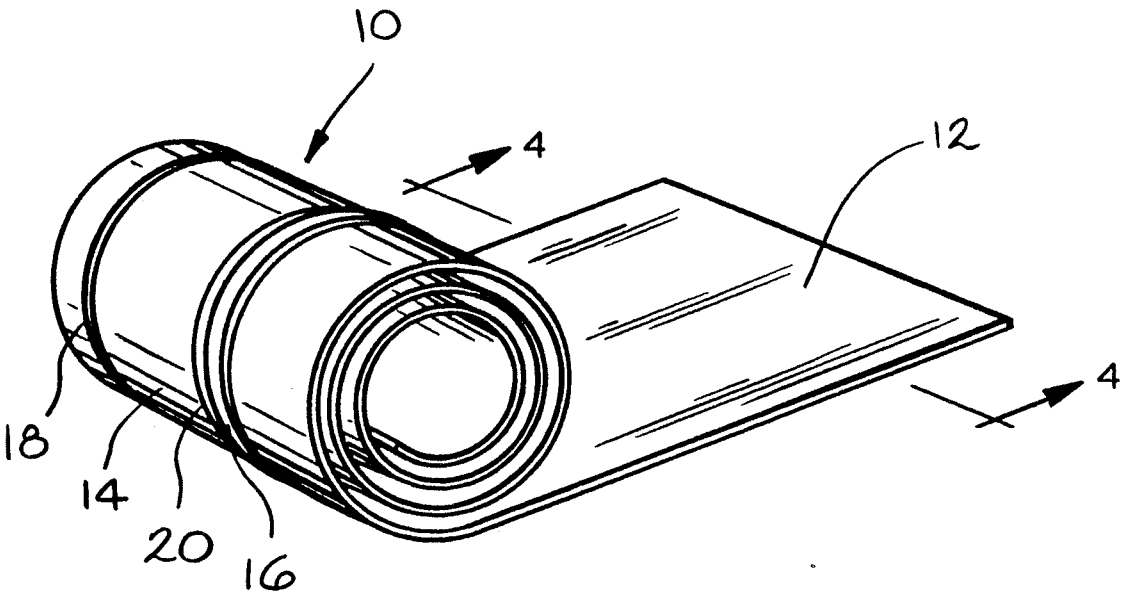
FIG. 3 is a perspective view of the drip edge partially coiled.

Drip edge 10 is first formed in the profile which approximates its installed shape such as illustrated in FIG. 1. In this initial state, each strip of drip edge 10 may have a length of several hundred feet. Web 14 is folded against cover flange 12 causing bending of joint 18 and lip 16 is folded against cover flange 12 causing bending of joint 20. This form, as illustrated in FIG. 4, is then rolled as indicated in FIG. 3 so as to coil cover flange 12 upon itself into the form shown in FIG. 2 for purposes of storage and transportation to the building or use site.

Drip edge 10 is preferably applied before the roof is shingled. It may, though, be utilized for existing roofs in which case, cover flange 12 is slid between the overlying roofing material and underlying roof board or applied over the existing roofing material prior to re-roofing. In describing its usual application, the coiled drip edge 10 is carried upon the roof and unrolled over the existing roof board 24. Roof board 24 can be in a variety of forms such as plywood sheeting and planking. The unrolled drip edge is then cut to length and web 14 extended and placed in an overlapping relationship relative to the fascia board 26 which extends along the roof edge. Fascia board 26 may be appropriately clad by covering 28. After being so applied along the edge of the roof, edge 10 may be stapled or nailed in position by having fasteners applied through the cover flange 12. If desired, edge 10 may be attached along the roof edge as the coiled edge is unrolled. Outer roofing material, such as shingles 30, is then applied over cover flange 12 and roof board 24. It is preferable in forming web 14 to orient the web relative to cover flange 12 at a general perpendicular or right angle to the cover flange so that when edge 10 is applied over the roof edge and web 14 drawn into contact with the underlying fascia board, there is an applied outward pressure upon web 14 which causes the web to biased inwardly against the fascia board or its covering 28, thus creating an improved seal between the web and the fascia board.

It is to be understood that the invention is not to be limited to the details above given, but may be modified within the following claims.

What I claim is:

1. A continuous roof drip edge comprising a cover flange adapted for positioning between an outer roofing material and roof board along a fascia board, a web extending from said cover flange at an angle of approximately 90 degrees and adapted to overlie a portion of said fascia board, said web connected to said cover flange by a flexible joint means thereby allowing said web to be folded against said cover flange, said flexible joint means being more flexible than said cover flange and said web, said flange and web having sufficient flexibility to allow said cover flange to be coiled upon itself with said web folded against the flange.

2. The roof drip edge of claim 1 and an out-turned lip extending from the opposite end of said web, said lip connected to said web by a second flexible joint means for allowing the lip to be folded against said cover flange substantially co-planar with the web when the web is folded against the cover flange, said lip having sufficient flexibility to allow said cover flange to be coiled upon itself with both the web and lip folded against the flange.

3. A continuous roof drip edge comprising a cover flange adapted for positioning between an outer roofing material and roof board along a fascia board, a web extending from said cover flange at approximately a right angle and adapted to overlie said fascia board, said web connected to said cover flange by flexible joint means for allowing the web to be folded against said cover flange, said flexible joint means being more flexible than said cover flange and said web, said flange and web being of elongated strip form and coiled along their lengthwise dimension with the web folded against the flange.

* * * * *